United States Patent [19]

Irvine

[11] 4,011,621

[45] Mar. 15, 1977

[54] WASHING APPARATUS

[76] Inventor: Joseph James King Irvine, 10 Ebrington Gardens, Belfast BT4 3BY, Northern Ireland

[22] Filed: Oct. 15, 1975

[21] Appl. No.: 622,616

[52] U.S. Cl. ..... 15/104.92; 15/76; 15/164

[51] Int. Cl.[2] ..... A47L 15/40; A47L 15/44; B08B 3/02

[58] Field of Search ..... 15/104.92, 67, 69, 75, 15/76, 164, 211; 134/53–55

[56] References Cited

UNITED STATES PATENTS

| | | | |
|---|---|---|---|
| 1,710,127 | 4/1929 | Vaughn | 15/106 |
| 2,268,721 | 1/1942 | Ossowsky | 15/75 X |
| 2,294,668 | 9/1942 | Karas | 15/164 UX |
| 3,121,897 | 2/1964 | Lambrich | 15/75 X |

FOREIGN PATENTS OR APPLICATIONS

| | | | |
|---|---|---|---|
| 1,056,687 | 10/1953 | France | 15/164 |
| 1,571,494 | 5/1969 | France | 15/75 |
| 785,863 | 5/1935 | France | 15/76 |
| 1,657,181 | 2/1971 | Germany | 15/164 |
| 845,908 | 8/1952 | Germany | 15/164 |
| 181,777 | 3/1936 | Switzerland | 134/55 |
| 2,928 | 2/1898 | United Kingdom | 15/76 |
| 306,694 | 2/1929 | United Kingdom | 15/75 |

*Primary Examiner*—Daniel Blum
*Attorney, Agent, or Firm*—Finnegan, Henderson, Farabow & Garrett

[57] ABSTRACT

A washing apparatus for tumblers and the like comprising an open-topped container, inlet means in communication therewith for connection to an external supply of cleansing liquid to allow continuous flow from the supply into the container, a first stationary brush unit having a plurality of inwardly directed bristles arranged peripherally around the inside face of the container and a second stationary brush unit comprising an upright member arranged centrally of the container and having a plurality of radially onwardly directed bristles. The open-topped container can be located within an outer jacket into which used cleansing liquid overflows from the container and which has outlet means for removal of the fluid overflow. A dispenser for the detergent is mounted on the outer face of the container or the outer jacket, and communicates with the interior of the container by piping the detergent flowing into the container through the piping at a rate pre-determined to ensure minimal frothing, the flow from the dispenser being controlled by a tap valve.

3 Claims, 4 Drawing Figures

WASHING APPARATUS

The present invention relates to a washing apparatus for use, for example, for cleaning drinking vessels such as glasses.

Heretofore in drinking establishments, dirty glasses to be cleaned are frequently merely dipped or rinsed in water by hand with the disadvantage that little or no effort is made to thoroughly clean the interior or exterior of the glass.

Washing apparatuses are known which to operate effectively require a power supply to rotate certain parts or a valve which causes water to flow only when it is actuated. Such apparatuses are of complicated construction, require periodic servicing by trained personnel for hygenic purposes apart from maintenance and must be dismantled for cleaning. Also, such apparatuses are designed for permanent installation, and no provision has been made for the dispensing of detergents or sterilizing agents into the washing water.

An object of the present invention is to obviate or mitigate these disadvantages.

The present invention is a washing apparatus for tumblers and the like comprising an open-topped container, inlet means in communication therewith for connection to an external supply of cleansing liquid to allow continuous flow from the supply into the container in an uninterrupted flow, a first stationary brush unit having a plurality of inwardly directed bristles arranged peripherally around the inside face of the container and a second stationary brush unit comprising an upright member arranged centrally of the container and having a plurality of radially outwardly directed bristles.

Embodiments of the present invention will now be described by way of example, with reference to the accompanying drawings in which.

Figure 1:
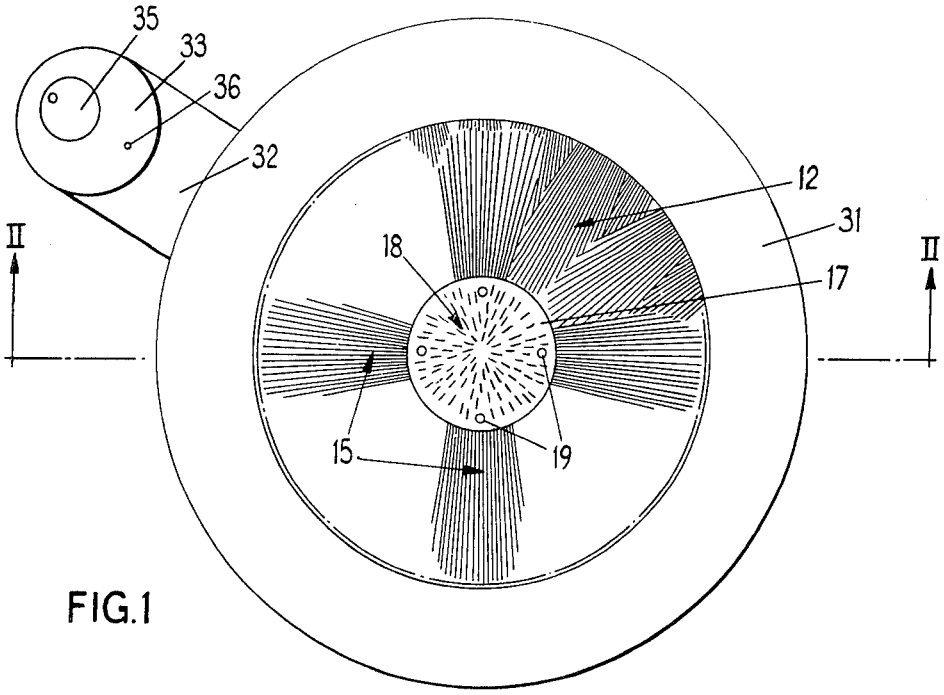
FIG. 1 is a plan view of a washing apparatus according to one embodiment of the present invention.
Figure 2:
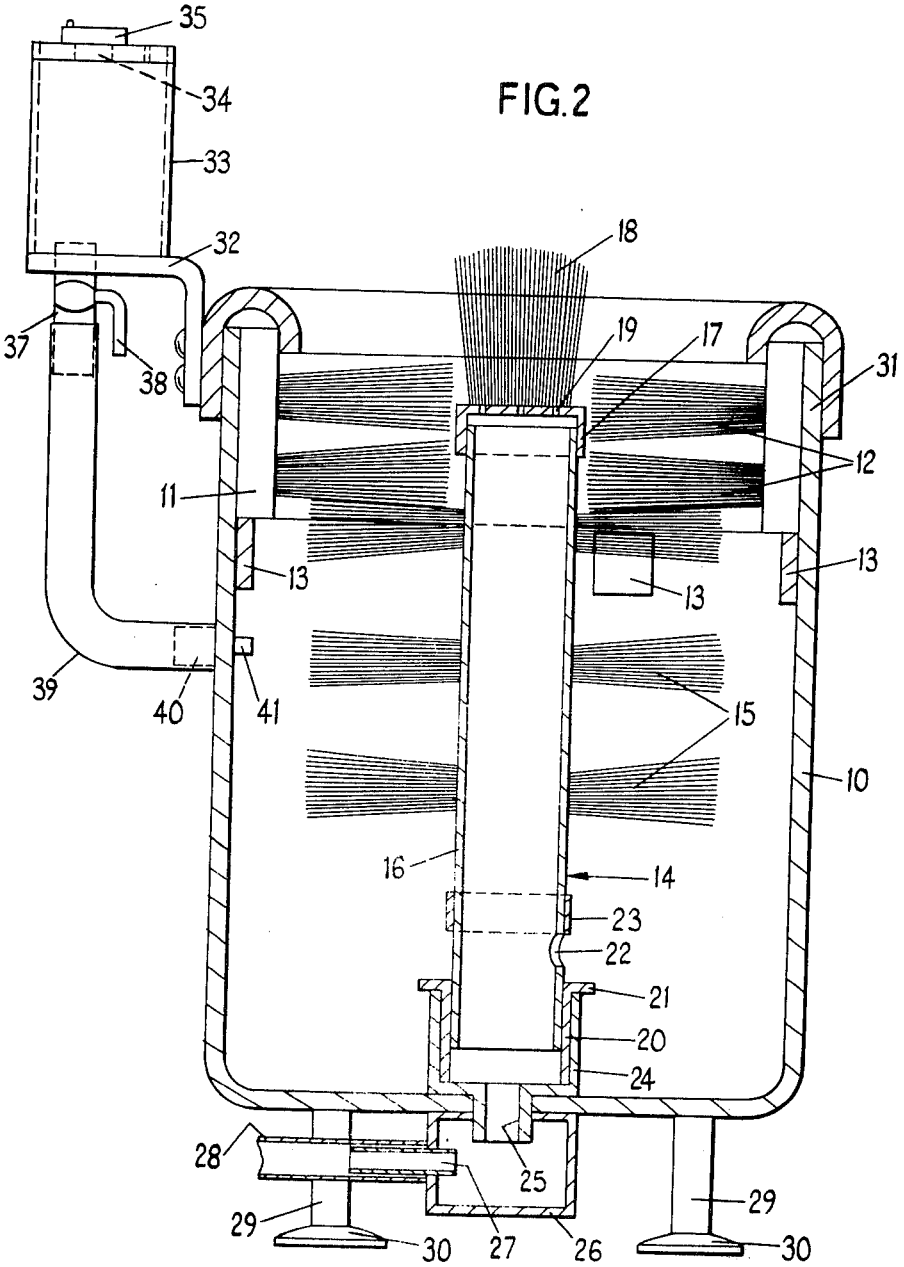
FIG. 2 is a cross-sectional view of the washing apparatus on the line II — II of FIG. 1.

Referring to FIGS. 1 and 2 of the drawings, a washing apparatus according to one embodiment comprises an open-topped cylindrical container 10 in which two stationary co-operating brush units are mounted. A first brush unit comprises an annular plate 11 having a plurality of inwardly directed bristle-like members, in this embodiment constituted by natural bristles 12. The plate 11 is arranged peripherally around the inside face of the container 10 and is in the form of a split-ring so that it is held in place by its resilience. In this embodiment, the plate 11 is of narrow depth, but it can be any desired depth, and has its upper edge flush with the top edge of the container 10. The plate 11 is supported in a vertical position by lugs 13 secured to the inside face of the container 10 to prevent downward movement and by an annular rim plate 31 to prevent upward movement. The rim plate 31 is of substantially inverted U-shaped cross-section, the outer edge of the inner limb contiguous to the bristles 12 adjacent to the plate 11 and the outer limb being extended and located around the outside top marginal edge of the container 10. A ring seal gland (not shown) may be located on the web of the rim plate 31 to abut against the top edges of the plate 11 and of the container 10. A second brush unit comprises an upright member 14 having a plurality of outwardly directed bristle-like members, in this embodiment constituted by natural bristles 15 at spaced locations along its length. The bristles 15 at and adjacent to the top of the upright 14 inter-engage with the bristles 12. The upright 14 is a tube 16, the upper end of which is capped by a detachable brush top 17 having a plurality of upwardly directed bristle-like members, in this embodiment constituted by natural bristles 18. A plurality of jet apertures 19 is provided in the top 17 arranged around the marginal periphery thereof, and communicating with the interior of the tube 16. The lower end of the tube 16 is open and located within a sleeve 20 having a peripheral lip 21 extending outwardly from the upper end thereof and the sleeve 20 fits snugly into a tubular mounting 24 upstanding axially on the base of the container 10. The base of the tubular mounting 24 has an axial bore 25 extending through the base of the container 10 to communicate with a cylindrical chamber 26 forming part of the liquid inlet means. An aperture 22 is provided radially in the tube 16 adjacent to the lip 21. The aperture 22 and jet apertures 19 form the tube aperture means by which the liquid can flow from the tube into the container. A collar 23 is located around the tube 16 for closing off or restricting the opening of the aperture 22 so as to increase the pressure of liquid passing through the jet apertures 19. This adjustment is made before the apparatus is in use by removing the entire upright 14, i.e. tube 16, sleeve 20 and collar 23, from the mounting 24, effecting the partial closing of the aperture 22 by moving the collar 23 and then re-positioning the upright 14 in the container 10 by re-inserting it into the tubular mounting 24. An inlet nozzle 27 is positioned radially in the side of the cylindrical chamber 26 and one end of a flexible pipe 28 is secured thereover, the other end having a conventional attachment (not shown) for securing the pipe 28 to an external supply of water, e.g., a tap (not shown). Three feet 29 are provided on the base of the container 10, each having a suction pad 30. The feet 29 raise the container 10 off a surface sufficiently to accommodate the cylindrical chamber 26. An angle bracket 32 is provided at the upper end of the container 10, mounted thereon by a first limb secured adjacent to its outer edge to the rim plate 31, the first limb extends upwardly from the container 10 with a second limb extending outwardly away from the container 10. A dispenser 33 is mounted on this second limb for holding a detergent which contains a wide spectrum disinfectant. This dispenser 33 is cylindrical and has a transparent side, the top having an inlet 34 over which a flap 35 is movable. A small air hole 36 is also provided in the top of the dispenser. The bottom of the dispenser 33 has an outlet pipe 37 projecting through the second limb and having therebelow a tap valve 38. The pipe 37, below the valve 38, is connected by a flexible pipe 39 to a nozzle 40 located on the wall of the container 10, the nozzle 40 having an outlet 41 on the inside of the container 10 below the level of the first brush unit.

The apparatus is used in drinking establishments such as hotels, public houses and bars. It is located in a sink, and the conventional attachment is located on a tap to connect the pipe 28 to a supply of water constituting the cleansing liquid. The tap valve 38 is opened to allow detergent in the dispenser to flow through pipe 39 into the container 10 via nozzle 40 and outlet 41. The tap is turned on and fresh water flows into the container 10 and the container 10 fills up and overflows into the sink to waste. During use, a continuous flow of fresh water is maintained thus providing optimum hygenic washing. The rate of flow of detergent into the water is pre-determined to ensure that frothing is minimal. As previously stated, the aperture 22 can be fully closed by moving the collar 23 over it thus closing it off so that the full force of the water can be directed to the jet apertures 19; in which case only the jet apertures 19 act as the tube aperture means when the aperture 22 is fully open the force of the water through the jet apertures 19 is minimal. Normally, however, the aperture 22 is partially closed to allow water to fill the container and to have some force when it comes out of the jet apertures 19. The inwardly and outwardly directed bristles inter-engage in such a way that varying sizes of glasses which are in common use in drinking establishments can be cleaned by inverting the glass, inserting it over the upright 14 so that the bristles 12, and 15 are disengaged and bent downwardly to engage the outside and inside of the glass respectively, and by moving the glass up and down with a slight twisting motion to completely clean the glass. Water fills the area between the inside of the glass and the upright 14, to give the inside of the glass a final rinse, the glass is lifted clear of the bristles and is then re-inserted into the bristles about one-third of the height of the glass.

Figure 3:
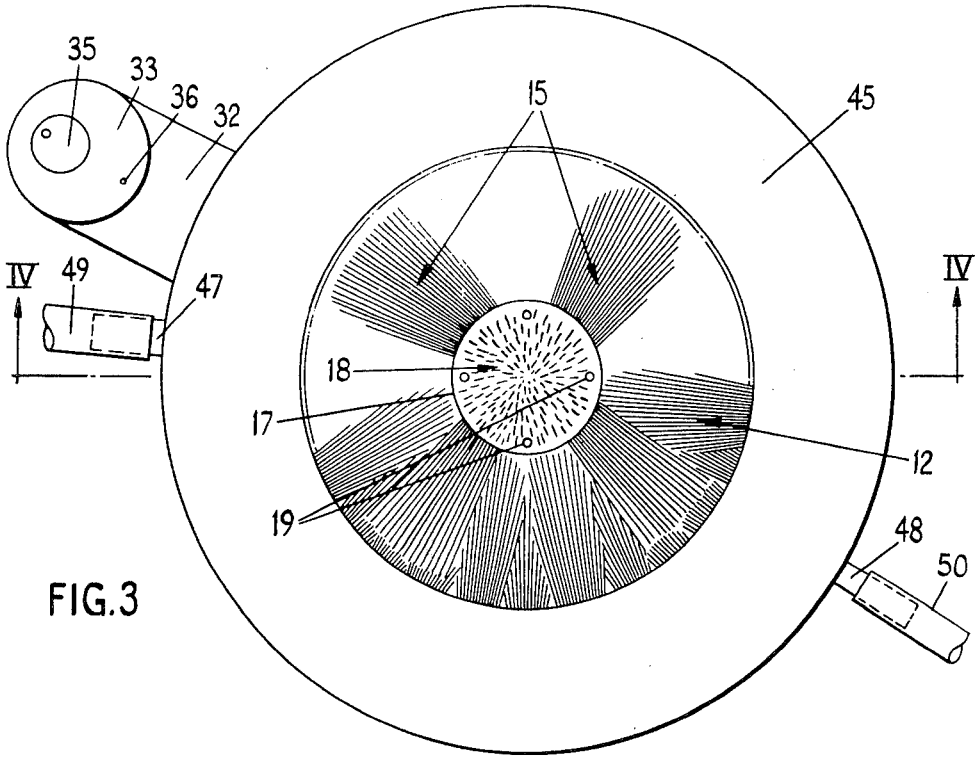
FIG. 3 is a plan view of a washing apparatus according to a second embodiment.
Figure 4:
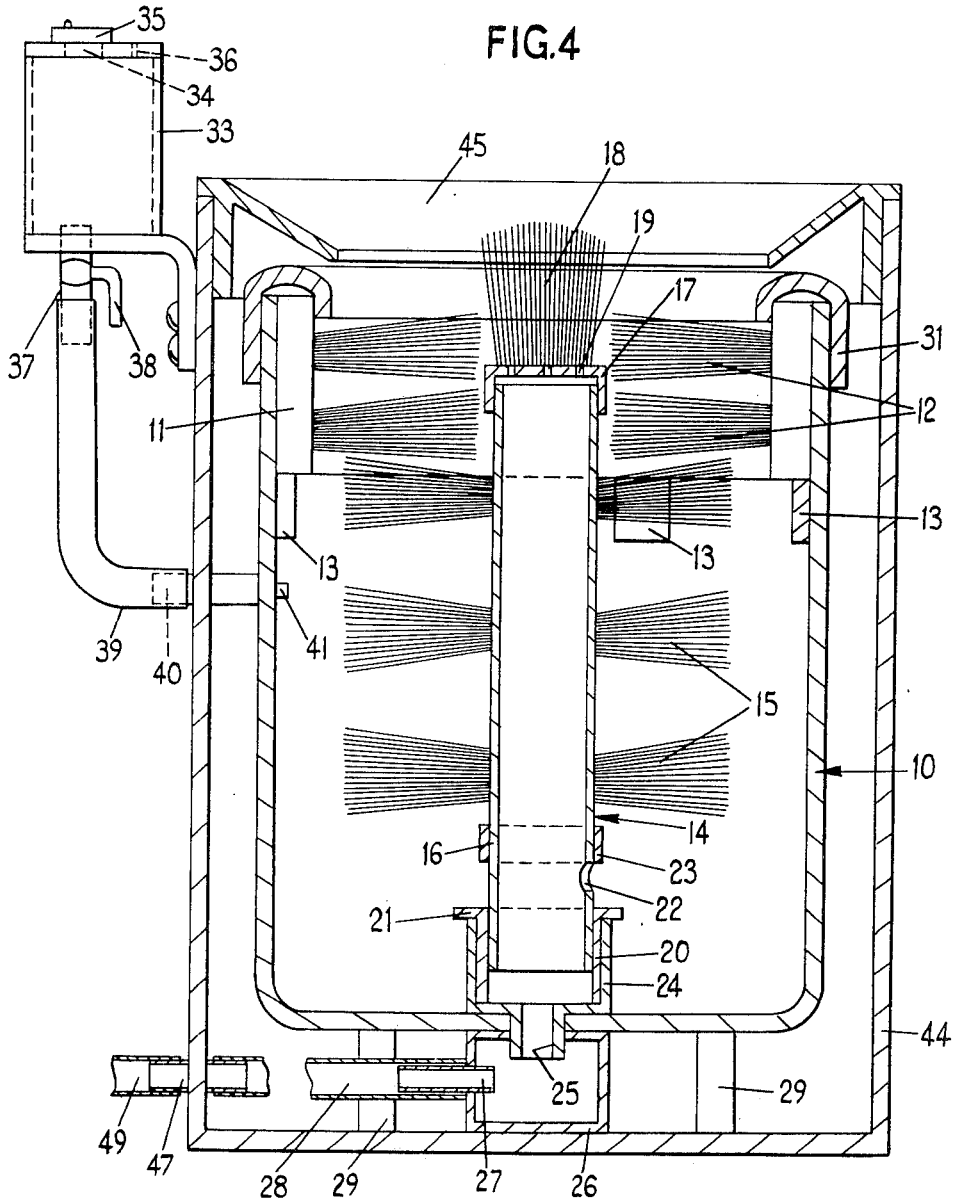
FIG. 4 is a cross-section view of the washing apparatus on the line IV — IV of FIG. 3.

In a second embodiment in which like parts are denoted by like numerals, a washing apparatus as shown in FIGS. 3 and 4 includes an open-topped cylindrical outer jacket 44 in which a modified version of the washing apparatus, as described in the first embodiment, is located co-axially therein. An annular splash plate 45 is detachably located in the top of the jacket 44, the inner edge of which plate overlies and is spaced above the rim plate 31 and the bristles 12 adjacent to the rim plate 31. The suction pads 30 described in the first embodiment are omitted and the feet 29 secured to the inside of the base of the jacket 44.

A further set of feet or suction pads may be mounted on the outside of the base of the jacket 44. The jacket 44 has two short pipes 47, 48 (FIG. 3) extending radially at spaced locations adjacent to the base thereof. Pipe 28 is shortened relative to the first embodiment and the outer end secured over the inward part of pipe 47. The outward part of pipe 47 is connected by a flexible pipe 49 to a source of water supply. Pipe 48 is for use as a waste pipe and is connected by a flexible pipe 50 to a sink or a waste pipe (not shown). The angle bracket 32 is mounted onto the outside of the jacket 44 and the nozzle 40 extends through the jacket 44 and is connected to the outlet 41 by a short piece of flexible piping 51, (FIG. 4).

The apparatus according to the second embodiment is located on, for example, a counter and pipe 49 is connected to a water supply and pipe 50 to a sink nearby. The washing operation is similar to that described in the first embodiment, the water overflowing from the container 10 under the splash plate 45 into the space between the container 10 and jacket 44 thence out through pipe 48, and pipe 50 to waste.

After use, the water supply is turned off, and the detergent tap valve closed. The container 10 of the first embodiment and jacket 44 of the second embodiment are emptied and then filled with a chemical to prevent growth of yeast spores and left in this fashion until it is required for use when the chemical is poured out and the container 10, or the container 10 and jacket 44 are rinsed and prepared ready for use as hereinbefore described.

The brush units can be easily removed and replaced when worn.

In a modification, the outside of the sleeve 20 may be in screw-threaded engagement with the inside of the tubular mounting 24.

The bristles may be other than natural bristles; for example, they may be constituted by bristles made from synthetic plastics material.

With the exception of pipe 37, tap valve 38, outlet 41 and nozzle 27, the rest of the parts in the washing apparatus in the first embodiment may be of synthetic plastics material and in the second embodiment, the jacket 44 and the splash plate 45 are of stainless steel, the splash plate 45 being rubber coated on its upper surface to prevent damage to any of the glasses being washed.

In a further modification, two washing apparatuses, as described in each embodiment, may be juxtaposed and used jointly, one for washing and one for rinsing the glasses; the apparatus used for rinsing may have the angle bracket 32 and the dispenser 33 removed.

Washing apparatus as hereinbefore described is advantageous in that it has no moving parts (except the adjustable collar) and no valves to interrupt the flow of water from the tap. It is conveniently connected to a mains tap which can be turned off when the apparatus is not in use. Another advantage is the provision of means for dispensing detergent which not only prevents the formation of scum but also sterilizes each glass as it is being washed.

I claim:

1. A washing apparatus for tumblers and the like comprising a container having an open top, inlet means in communication with the container for connection to an external supply of cleansing liquid to allow continuous flow from the supply into the container, a first stationary brush unit having a plurality of inwardly directed bristles and arranged peripherally on the container and a second stationary brush unit comprising an upright tubular member arranged centrally of the container and having a plurality of radially outwardly directed bristles, said tubular member having an open lower end in communication with said inlet means for passage of cleansing fluid into the tubular member, a top end which has a plurality of jet apertures therein, an aperture in the side of the tubular member adjacent the lower end thereof and adjustment means associated with said aperture in the side of the tubular member to vary the rate of flow of liquid through said aperture and consequently to vary the force of cleansing liquid passing through the plurality of jet apertures.

2. A washing apparatus according to claim 1, wherein said means to vary the rate of flow comprises a collar located around the tube and movable to overlie said aperture.

3. A washing apparatus according to claim 1, wherein the first stationary brush unit includes an annular plate in the form of a split-ring, and wherein means for supporting the first stationary brush unit peripherally on the container consists of a plurality of lugs.

* * * * *